US005618193A

United States Patent [19]

Nakajima et al.

[11] Patent Number: 5,618,193

[45] Date of Patent: Apr. 8, 1997

[54] STRUCTURE FOR CONNECTING SPARK PLUG AND IGNITION COIL FOR INTERNAL COMBUSTION

[75] Inventors: Keiichi Nakajima; Tadashi Fujita, both of Yokkaichi; Tetsuya Miwa, Kariya, all of Japan

[73] Assignees: Sumitomo Wiring Systems, Ltd.; Nippondenso Company, Ltd., both of Japan

[21] Appl. No.: 555,010

[22] Filed: Nov. 13, 1995

[30] Foreign Application Priority Data

Nov. 22, 1994 [JP] Japan ..... 6-288234

[51] Int. Cl.[6] ..... F02P 17/00

[52] U.S. Cl. ..... 439/125; 439/126; 439/127; 439/128; 123/169 PA; 123/143 C; 123/647

[58] Field of Search ..... 439/125, 126, 439/127, 128, 206, 199; 123/169 PA, 647, 143 C

[56] References Cited

U.S. PATENT DOCUMENTS

| | | | |
|---|---|---|---|
| 1,979,999 | 11/1934 | Rabezzana | 439/125 |
| 2,686,509 | 8/1954 | Drinkard | 439/125 |
| 4,562,813 | 1/1986 | Okado et al. | 123/647 |
| 4,989,575 | 2/1991 | Kanno | 123/169 PA |
| 5,170,767 | 12/1992 | Wada et al. | 123/169 PA |
| 5,215,475 | 6/1993 | Stevens | 439/206 |
| 5,377,640 | 1/1995 | Kobayashi | 123/143 C |
| 5,462,023 | 10/1995 | Furuya | 123/143 C |
| 5,487,676 | 1/1996 | Maruyama et al. | 439/125 |

FOREIGN PATENT DOCUMENTS

| | | | |
|---|---|---|---|
| 0580295 | 1/1994 | European Pat. Off. . | |
| 725446 | 5/1932 | France | 439/125 |
| 658237 | 3/1994 | Japan . | |

*Primary Examiner*—David L. Pirlot
*Assistant Examiner*—Tho D. Ta
*Attorney, Agent, or Firm*—Jordan B. Bierman; Bierman and Muserlian

[57] ABSTRACT

A terminal portion (11) of a spark plug (10) and a connecting terminal (22) of an ignition coil (20) are connected through a coil spring (30) serving as a conductive member which in turn is covered with an insulating member (40) having a cap (41), a sleeve (47) and a bushing (48) and extending from the terminal portion (11) to a high-tension tower (21). A first air vent hole (44) is defined by an upper surface of a collar portion (42) of the cap (41) and a bottom surface of an ignition coil body (23) in intimate contact with the upper surface, and a plurality of reservoir spaces (45) having a greater volume than the first air vent hole (44) are formed in circumferentially spaced apart relation along the first air vent hole (44). A second air vent hole (46) is formed in the cap (41) for communication between the first air vent hole (44) and the interior of a plug hole (H). This provides a structure for connecting the spark plug and the ignition coil which prevents water from entering the plug hole through the air vent holes when a cylinder head is subjected to high-pressure water.

6 Claims, 5 Drawing Sheets

STRUCTURE FOR CONNECTING SPARK PLUG AND IGNITION COIL FOR INTERNAL COMBUSTION

BACKGROUND OF THE INVENTION

1. Field of the Invention

The present invention relates to a structure for connecting an ignition coil and a spark plug for use in an internal combustion engine.

2. Description of the Background Art

Referring to FIGS. 6 and 7, a spark plug 51 mounted in the bottom of a plug hole H formed in a cylinder head C and an ignition coil 52 fixed on the cylinder head C are electrically connected in a manner to be described below.

A connecting terminal 53 projecting downwardly from the underside of the ignition coil 52 is electrically connected to a terminal 54 of the spark plug 51 which projects upwardly in the cylinder head C through a conductive member 55 such as a single spring, a metal round bar, and a metal cylinder. An insulating member 56 covers an outer periphery of the conductive member 55 to extend from the connecting terminal 53 to the terminal 54.

There are two types of insulating members 56. One type is an insulating member comprised of three members: a cap for covering the range from the connecting terminal 53 to the conductive member 55, a bushing for covering the range from the terminal 54 to the conductive member 55, and a sleeve for covering the conductive member 55 to extend from the cap to the bushing. The other type is an insulating member comprised of the cap, bushing and sleeve which are formed integrally. In either case, the cap or a portion corresponding to the cap is fitted in an upper portion of the plug hole C in such a manner that an upper surface thereof is in intimate contact with the underside of the ignition coil 52 and an outer periphery thereof is in intimate contact with an inner peripheral surface of the plug hole H.

A first air vent hole 57 is formed in the contact portion between the upper surface of the cap or the portion corresponding to the cap and the bottom surface of the ignition coil 52 and extends from the outer edge of the contact portion. A second air vent hole 58 for communication between the first air vent hole 57 and the interior of the plug hole H is formed in the cap or the portion corresponding to the cap.

When the air in the plug hole H is heated to expand, the expanded amount of air may be escaped through the first and second air vent holes 57 and 58, preventing changes in pressure in the plug hole H.

The above stated connecting structure presents no significant problem when the cylinder head C is exposed to a small amount of water. However, when the cylinder head C is subjected to high-pressure water, for example, during car washing, water might enter the plug hole H through the first and second air vent holes 57 and 58.

SUMMARY OF THE INVENTION

A first aspect of the present invention is directed to a structure for connecting a spark plug and an ignition coil for an internal combustion engine. According to the present invention, the structure comprises: a spark plug mounted in the bottom of a plug hole formed in a cylinder head; an ignition coil mounted on the cylinder head and having a lid portion for closing an upper opening of the plug hole; and a connecting member for electrically and mechanically connecting the ignition coil and the spark plug in the plug hole, the connecting member including an insulating cap between the lid portion of the ignition coil and the cylinder head and in intimate contact with a bottom surface of the lid portion and a periphery of the upper opening of the plug hole, there being a first air vent passage between the insulating cap and the lid portion and in communication with the exterior, the insulating cap having a second air vent passage for communication between the first air vent passage and the interior of tile plug hole, there being a large-volume reservoir space between the insulating cap and the lid portion at a position along the first air vent passage and having a cross-sectional area enlarged from the first air vent passage.

Preferably, according to a second aspect of the present invention, the first air vent passage is defined by a space surrounded by a groove formed in an upper surface of the insulating cap and the bottom surface of the lid portion.

Preferably, according to a third aspect of the present invention, the first air vent passage is defined by a space surrounded by an upper surface of the insulating cap and a groove formed in the bottom surface of the lid portion.

Preferably, according to a fourth aspect of the present invention, the first air vent passage is defined by a space surrounded by a groove formed in an upper surface of the insulating cap and a groove formed in the bottom surface of the lid portion.

Preferably, according to a fifth aspect of the present invention, the reservoir space is defined by a space surrounded by a recess formed in the upper surface of the insulating cap and the bottom surface of the lid portion.

Preferably, according to a sixth aspect of the present invention, the reservoir space is defined by a space surrounded by the upper surface of the insulating cap and a recess formed in the bottom surface of the lid portion.

Preferably, according to a seventh aspect of the present invention, the reservoir space is defined by a space surrounded by a recess formed in the upper surface of the insulating cap and a recess formed in the bottom surface of the lid portion.

According to an eighth aspect of the present invention, the structure comprises: a spark plug mounted in the bottom of a plug hole formed in a cylinder head; an ignition coil including a bar-shaped coil body portion received in the plug hole, a plug connecting portion at the lower end of the coil body portion and connected to the spark plug, and a lid portion at the upper end of the coil body portion and located exteriorly of the plug hole; and an annular rubber member provided between the lid portion of the ignition coil and the cylinder head and in intimate contact with a bottom surface of the lid portion and a periphery of an upper opening of the plug hole, there being a first air vent passage between the annular rubber member and the lid portion and in communication with the exterior, the annular rubber member having a second air vent passage for communication between the first air vent passage and the interior of the plug hole, there being a large-volume reservoir space between the annular rubber member and the lid portion at a position along the first air vent passage and having a cross-sectional area enlarged from the first air vent passage.

Preferably, according to a ninth aspect of the present invention, the first air vent passage is defined by a space surrounded by a groove formed in an upper surface of the annular rubber member and the bottom surface of the lid portion.

Preferably, according to a tenth aspect of the present invention, the reservoir space is defined by a space surrounded by a recess formed in the upper surface of the annular rubber member and the bottom surface of the lid portion.

Preferably, according to an eleventh aspect of the present invention, the lid portion of the ignition coil includes a fixing stay for fixing the ignition coil to the cylinder head, and an electrical connector for connecting a signalling line from an ignition controller to the ignition coil; and an end of the first air vent passage which is open to the exterior is located under the fixing stay or the electrical connector.

Preferably, according to a twelfth aspect of the present invention, the annular rubber member and the ignition coil include a mechanism for preventing the annular rubber member from rotating relative to the ignition coil.

Preferably, according to a thirteenth aspect of the present invention, the annular rubber member is prevented from rotating relative to the ignition coil by bringing a projection formed on an outer peripheral surface of the coil body portion into engagement with a recess formed in an inner peripheral surface of the annular rubber member.

In the structure for connecting the ignition coil and the spark plug as above constructed, when the cylinder head is subjected to high-pressure water, the reservoir space at a position along the first air vent passage stores water from the first air vent passage therein to limit the force of the water. Thus it is difficult and it takes much time for water to reach the plug hole, and the entry of water into the plug hole is effectively prevented.

The provision of the reservoir space in the cap or ignition coil is effective in reducing the weight of the structure itself.

It is therefore an object of the present invention to provide a structure for connecting an ignition coil and a spark plug which prevents water from entering a plug hole through an air vent passage when a cylinder head is subjected to high-pressure water.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
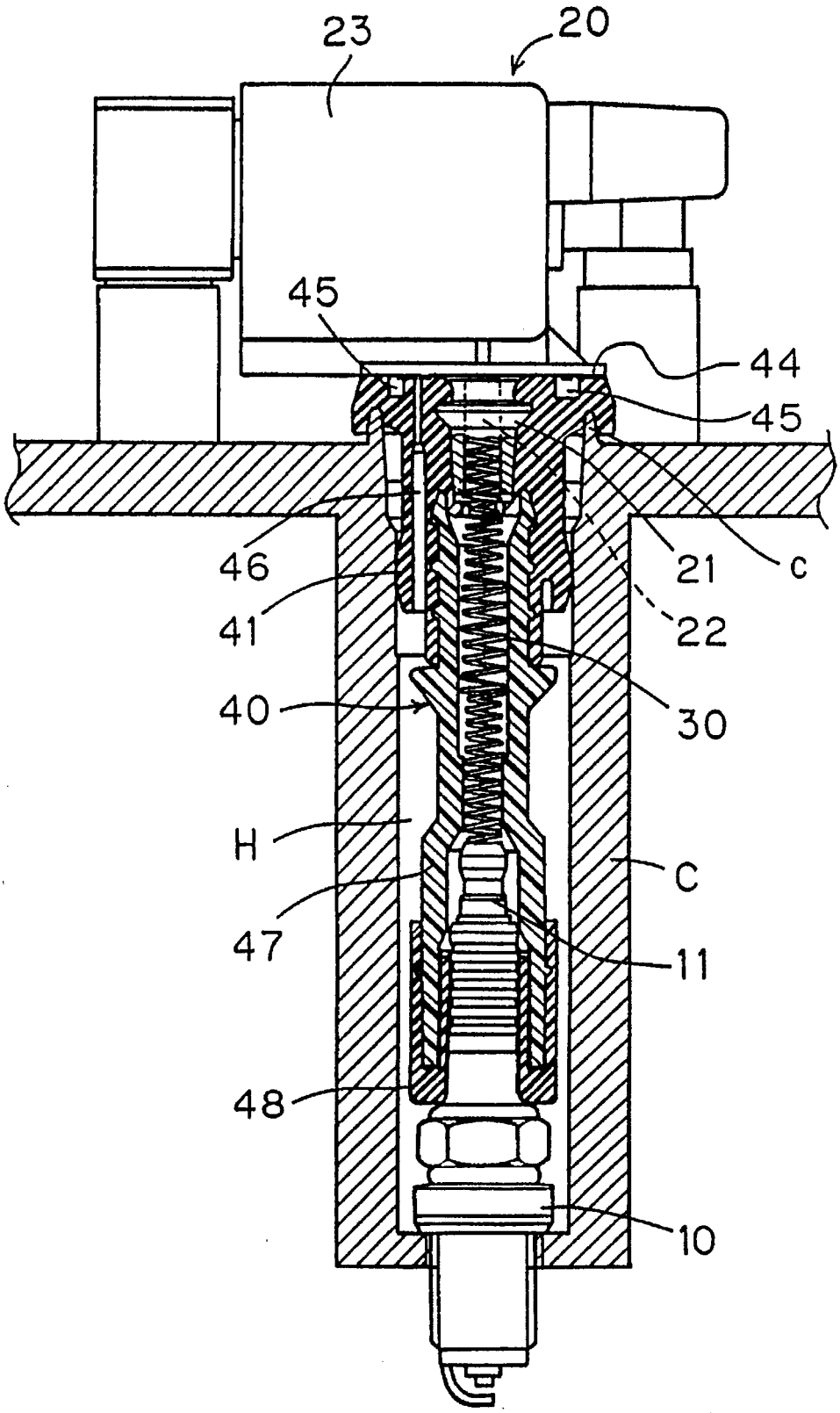
FIG. 1 is a fragmentary cross-sectional view of a first preferred embodiment according to the present invention.

Preferred embodiments according to the present invention will now be described with reference to the drawings. Referring to FIG. 1, a spark plug 10 is fixed in the bottom of a plug hole H formed in a cylinder head C so that a terminal portion 11 projects upwardly. An ignition coil 20 is mounted on the opening periphery of the plug hole H of the cylinder head C so that a high-tension tower 21 having a connecting terminal 22 projects from a bottom surface of an ignition coil body 23 toward the interior of the plug hole H. The ignition coil 20 includes a disc portion serving as a lid portion.

The terminal portion 11 of the spark plug 10 is connected to the connecting terminal 22 of the ignition coil 20 through a coil spring 30 serving as a conductive member. The coil spring 30 is covered with an insulating member 40 extending from the terminal portion 11 to the high-tension tower 21.

Figure 2:
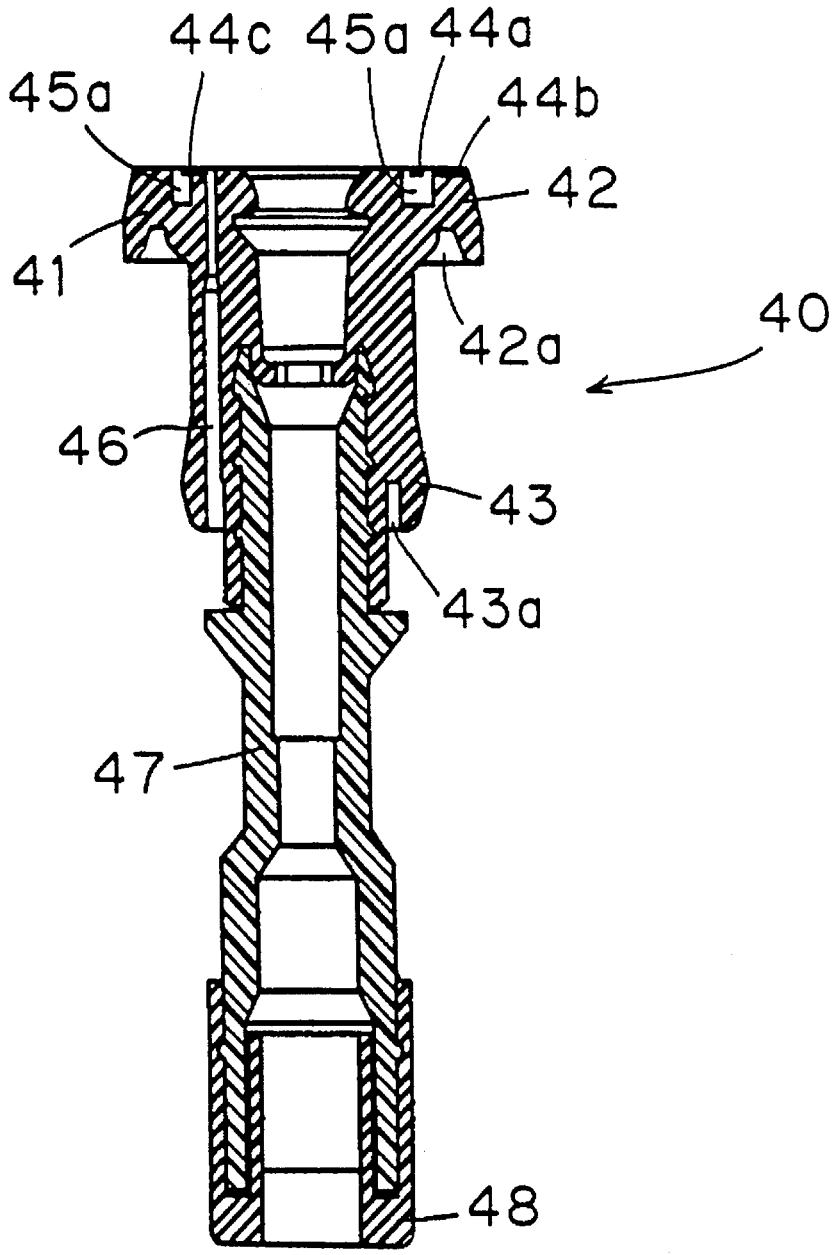
FIG. 2 is a cross-sectional view of an insulating member of the first preferred embodiment.

As shown in FIGS. 1 and 2, the insulating member 40 comprises a sleeve 47 receiving the coil spring 30 for covering the terminal portion 11 of the spark plug 10, a cap 41 for covering the range from the high-tension tower 21 of the ignition coil 20 to an upper portion of the sleeve 47, and a bushing 48 mounted to the sleeve 47 from therebelow for covering the inner and outer surfaces of a lower portion of the sleeve 47. The sleeve 47, cap 41 and bushing 48 are made of an insulating resin. More specifically, the sleeve 47 is made of a rigid resin, and the cap 41 and bushing 48 are made of rubber.

Figure 3A:
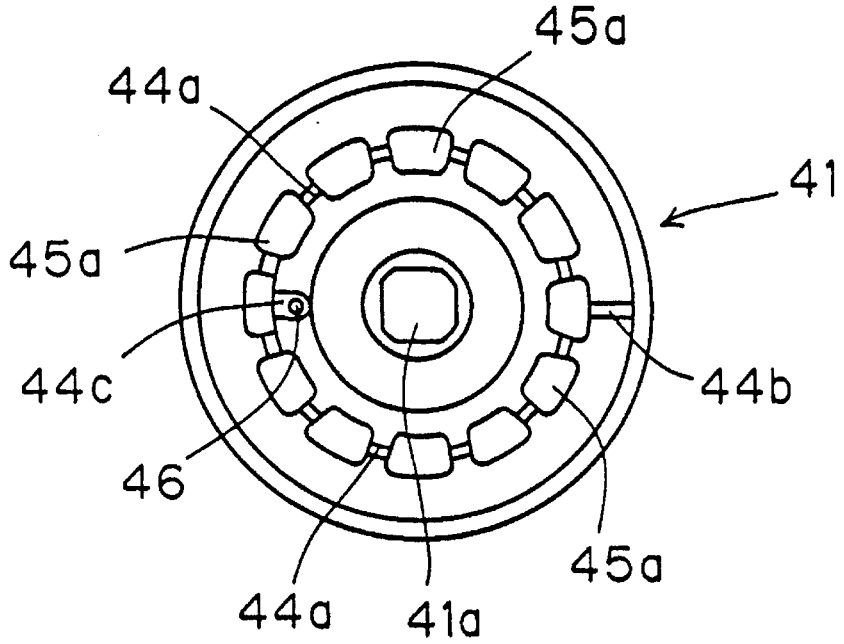
FIGS. 3A and 3B illustrate a cap of the first preferred embodiment.
Figure 3B:
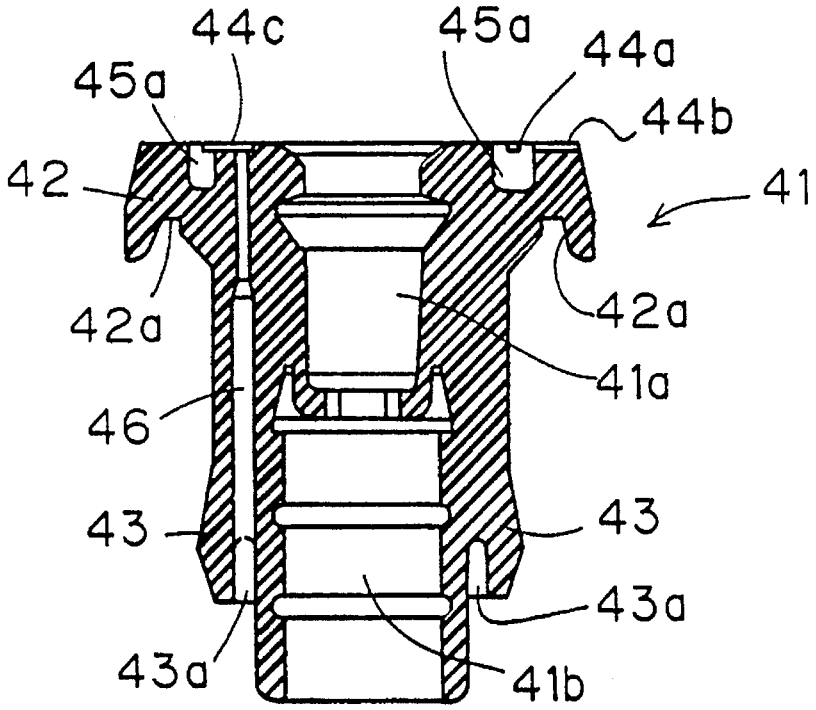

Referring to FIGS. 3A and 3B, the cap 41 includes, in its upper end portion, an outwardly extending collar portion 42 having an upper surface in intimate contact with a bottom surface of the disc portion of the ignition coil body 23. The lower surface of the collar portion 42 is in intimate contact with the opening periphery of the plug hole H and has a groove 42*a* formed circumferentially and receiving a ledge c formed in the peripheral portion of the plug hole H of the cylinder head C for positioning the cap 41.

The cap 41 comprises a high-tension tower receiving portion 41*a* for receiving the high-tension tower 21 of the ignition coil 20, and a sleeve receiving portion 41*b* formed in continuation to the high-tension tower receiving portion 41*a* for receiving the upper end portion of the sleeve 47 covering the coil spring 30. The high-tension tower receiving portion 41*a* and the sleeve receiving portion 41*b* have inner surface configurations corresponding respectively to the outer surface configurations of the high-tension tower 21 and sleeve 47. A lower outer peripheral surface of the cap 41 has a bump portion 43 raised outwardly so that an outer surface of the bump portion 43 is in intimate contact with the inner peripheral surface of the plug hole H when the cap 41 is fitted in the plug hole H. The bump portion 43 has a circumferential groove 43*a* formed throughout the entire circumference for ease of fitting in the plug hole H.

A circumferential groove 44*a* and a communication groove 44*b* extending from the circumferential groove 44*a* to the outer edge of the collar portion 42 are formed in the upper surface of the collar portion 42. A plurality of recesses 45*a* which are wider and deeper than the circumferential groove 44*a* are formed in circumferentially spaced apart relation along the circumferential groove 44*a*. A communication groove 44c extends radially inwardly from one of the recesses 45*a*.

Thus, as shown in FIG. 1, the circumferential groove 44*a* and communication grooves 44*b*, 44*c* and the bottom surface of the ignition coil body 23 which is in intimate contact with the upper surface of the collar portion 42 define a first air vent hole 44 serving as a first air vent passage, and the recesses 45*a* and the bottom surface of the ignition coil body 23 define reservoir spaces 45 in circumferential positions along the air vent hole 44.

The cap 41 has a second air vent hole 46 as a second air vent passage extending from a bottom surface of the communication groove 44*c* and in communication with the circumferential groove 43*a* formed in the bump portion 43. With the cap 41 fitted in the plug hole H, excess air in the plug hole H is discharged out of the plug hole H through the first and second air vent holes 44 and 46.

In the structure for connecting the ignition coil and spark plug as above constructed, water might enter the first air vent hole 44 when the cylinder head C and the ignition coil 20 are subjected to high-pressure water. However, the water which has entered the first air vent hole 44 is stored in the reservoir spaces 45 at circumferential positions along the first air vent hole 44 to provide a limited force. Thus it is difficult and it takes much time for water to reach the second air vent hole 46.

Therefore, when the cylinder head C and ignition coil 20 are subjected to high-pressure water, there is little likelihood that water enters the plug hole H, and watertight performance is improved. For improvement in watertight performance, it is important to provide the air vent passage which is partially enlarged in cross section and to capture waterdrops in the enlarged spaces as in the first preferred embodiment. It is, in particular, significant to provide the reservoir spaces 45 having a cross-sectional area sufficiently greater than the air vent passage in the direction of water flow.

When the cap 41 is positioned by fitting the ledge c formed on the peripheral portion of the plug hole H of the cylinder head C into the groove 42*a* formed in the collar portion 42 of the cap 41 as in the first preferred embodiment, the reservoir spaces 45 function as a relief of the synthetic resin of the collar portion 42 compressed between the bottom surface of the ignition coil body 23 and the ledge c.

In the first preferred embodiment, the first air vent hole 44 and reservoir spaces 45 are defined by the circumferential groove 44*a*, communication grooves 44*b*, 44*c* and recesses 45*a* formed in the upper surface of the cap 41 and the flat bottom surface of the ignition coil body 23 as above stated. Conversely, the first air vent hole 44 and reservoir spaces 45 may be defined by similar grooves and recesses formed in the bottom surface of the ignition coil body 23 and the flat upper surface of the cap 41. Alternatively, the first air vent hole 44 and reservoir spaces 45 may be defined by the combination of corresponding grooves and recesses formed in both of the upper surface of the cap 41 and the bottom surface of the ignition coil body 23.

The conductive member employs the coil spring 30 in the first preferred embodiment but is not limited thereto. For example, a metal round bar, a metal cylinder or a combination thereof with a coil spring may be used as the conductive member. The insulating member of the first preferred embodiment comprises three members: the cap 41, the sleeve 47, and the bushing 48. However, the cap 41, sleeve 47 and bushing 48 may be formed integrally.

Figure 4:
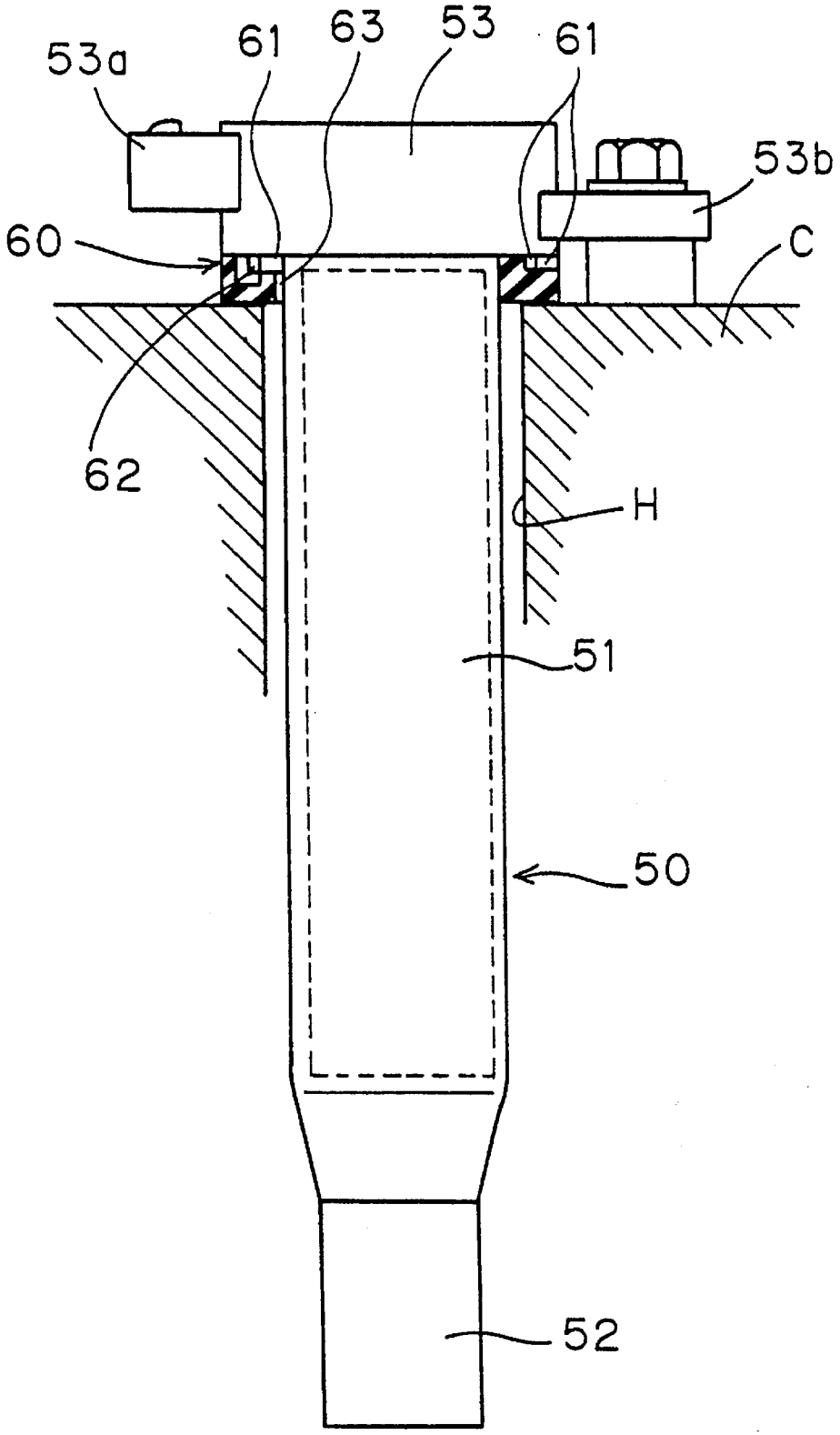
FIG. 4 is a fragmentary cross-sectional view of a second preferred embodiment according to the present invention.
Figure 5:
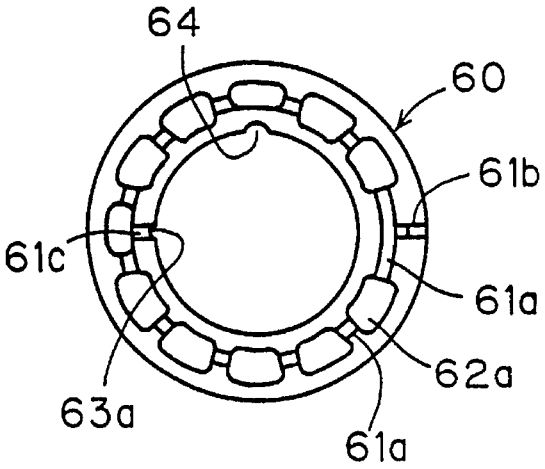
FIG. 5 is a plan view of an annular rubber member of the second preferred embodiment.
Figure 6:
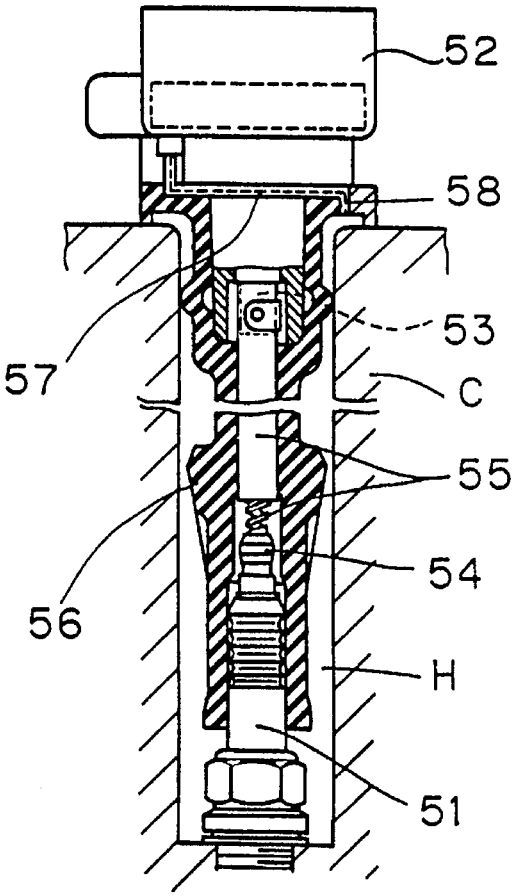
FIG. 6 is a fragmentary cross-sectional view of the background art.
Figure 7:
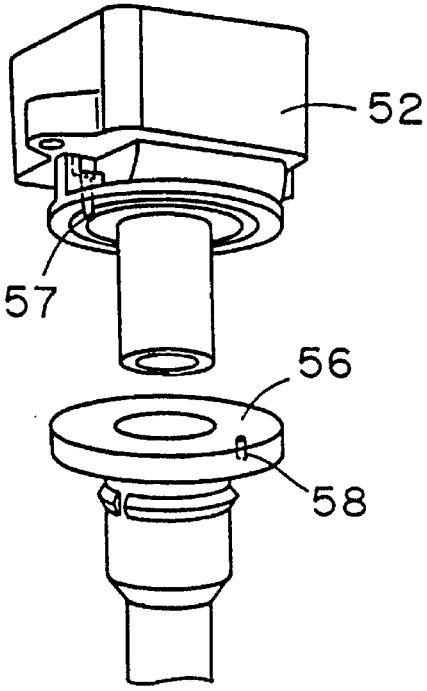
FIG. 7 is an exploded perspective view of the details of an ignition coil and a cap portion of the background art.

FIGS. 4 and 5 illustrate a second preferred embodiment according to the present invention. Described in the first preferred embodiment is the structure for connecting the spark plug 10 and the ignition coil 20 of the type located exteriorly of the plug hole H formed in the cylinder head C. Description will be given on a structure for connecting the spark plug and an ignition coil 50 of the type located within the plug hole H in the second preferred embodiment.

Although not shown, the spark plug is fixed in the bottom of the plug hole H formed in the cylinder head C so that the terminal portion thereof projects upwardly as in the first preferred embodiment.

Referring to FIG. 4, the ignition coil 50 comprises a coil body portion 51 received in the plug hole H, a plug connecting portion 52 at the lower end of the coil body portion 51 and connected to the terminal portion of the spark plug, and a lid portion 53 at the upper end of the; coil body portion 51 and extending in the form of an umbrella.

The coil body portion 51 is bar-shaped so as to be received in the plug hole H, and contains a magnetic core, a primary coil, and a secondary coil in the portion indicated by the broken lines of FIG. 4.

The lid portion 53 is located exteriorly of the plug hole H as shown in FIG. 4 and includes an electrical connector 53*a* for connecting a signalling line (not shown) from an ignition controller to the ignition coil 50, and a fixing stay 53*b* for fixing the ignition coil 50 to the cylinder head C. The electrical connector 53*a* and the fixing stay 53*b* project in opposite directions.

An annular rubber member 60 is fitted on the coil body portion 51 in intimate contact therewith between the lid portion 53 of the ignition coil 50 and the cylinder head C and acts as a watertight member. The upper and lower surfaces of the annular rubber member 60 are adapted to closely contact a lower surface of the lid portion 53 and an upper surface of the cylinder head C, respectively.

Referring to FIG. 5, a circumferential groove 61*a* and a communication groove 61*b* extending form the circumferential groove 61a to the outer edge are formed in the upper surface of the annular rubber member 60. A plurality of recesses 62*a* which are wider and deeper than the circumferential groove 61*a* are formed in circumferentially spaced apart relation along the circumferential groove 61*a*. A communication groove 61*c* extends radially inwardly from one of the recesses 62*a*.

Thus, as shown in FIG. 4, the circumferential groove 61*a* and communication grooves 61*b*, 61*c* and the bottom surface of the lid portion 53 which is in intimate contact with the upper surface of the annular rubber member 60 define a first air vent hole 61 serving as an air vent passage, and the recesses 62*a* and the bottom surface of the lid portion 53 define reservoir spaces 62 in circumferential positions along the air vent hole 61.

A vertical groove 63*a* in communication with an end of the communication groove 61*c* is formed in an inner peripheral surface of the annular rubber member 60. The vertical groove 63*a* and the outer peripheral surface of the coil body portion 51 which is in intimate contact with the inner peripheral surface of the annular rubber member 60 define a second air vent hole 63 in communication with the first air vent hole 61 and the interior of the plug hole H.

A recess 64 is formed in the inner peripheral surface of the annular rubber member 60 to engage a projection (not shown) formed on the outer peripheral surface of the coil body portion 51, preventing the annular rubber member 60 from rotating relative to the ignition coil 50 fixed to the cylinder head C. The recess 64 is located so that an end of the first air vent hole 61 which is open to the exterior is located under the fixing stay 53*b* of the lid portion 53 (FIG. 4).

The end of the first air vent hole 61 which is open to the exterior is located under the fixing stay 53*b* in the second preferred embodiment, but the present invention is not limited thereto. For example, the recess 64 may be located so that the end of the first air vent hole 61 which is open to the exterior is located under the electrical connector 53*a*.

In the second preferred embodiment, the second air vent hole 63 is defined by the vertical groove 63*a* formed in the annular rubber member 60 and the outer peripheral surface of the coil body portion 51. Like the first preferred embodiment, the second air vent hole 63 may be formed directly in the annular rubber member 60.

In the structure for connecting the ignition coil 50 and the spark plug as above constructed, the coil body portion 51 is received in the plug hole H. Thus, when the end of the first air vent hole 61 which is open to the exterior must be located in close proximity to the upper surface of the cylinder head C, the reservoir spaces formed in circumferential positions along the first air vent hole 61 may capture the water which has entered the first air vent hole 61 to prevent water from entering the plug hole H. Further, since the end of the first air vent hole 61 which is open to the exterior is located under the fixing stay 53*b* or electrical connector 53*a* of the lid portion 53 as above described, the end of the first air vent hole 61 which is open to the exterior is prevented from being exposed to water directly. This further reduces the amount of water which enters the first air vent hole 61.

While the invention has been described in detail, the foregoing description is in all aspects illustrative and not restrictive. It is understood that numerous other modifications and variations can be devised without departing from the scope of the invention.

We claim:

1. A structure for connecting a spark plug and an ignition coil for an internal combustion engine, comprising:

a spark plug mounted in the bottom of a plug hole formed in a cylinder head;

an ignition coil including a bar-shaped coil body portion received in said plug hole, a plug connecting portion at the lower end of said coil body portion and connected to said spark plug, and a lid portion at the upper end of said coil body portion and located exteriorly of said plug hole; and an annular rubber member provided between said lid portion of said ignition coil and said cylinder head and in intimate contact with a bottom surface of said lid portion and a periphery of an upper opening of said plug hole, there being a first air vent passage between said annular rubber member and said lid portion and in communication with the exterior, said annular rubber member having a second air vent passage for communication between said first air vent passage and the interior of said plug hole, there being a large-volume reservoir space between said annular rubber member and said lid portion at a position along said first air vent passage and having a cross-sectional area enlarged from said first air vent passage.

2. The structure of claim 1, wherein said first air vent passage is defined by a space surrounded by a groove formed in an upper surface of said annular rubber member and the bottom surface of said lid portion.

3. The structure of claim 2, wherein said reservoir space is defined by a space surrounded by a recess formed in the upper surface of said annular rubber member and the bottom surface of said lid portion.

4. The structure of claim 1, wherein said lid portion of said ignition coil includes:

a fixing stay for fixing said ignition coil to said cylinder head; and an electrical connector for connecting a signalling line from an ignition controller to said ignition coil, and wherein an end of said first air vent passage which is open to the exterior is located under said fixing stay or said electrical connector.

5. The structure of claim 4, wherein said annular rubber member and said ignition coil include a mechanism for preventing said annular rubber member from rotating relative to said ignition coil.

6. The structure of claim 5, wherein said annular rubber member is prevented from rotating relative to said ignition coil by bringing a projection formed on an outer peripheral surface of said coil body portion into engagement with a recess formed in an inner peripheral surface of said annular rubber member.

* * * * *